US007889839B2

(12) United States Patent
Bermuth et al.

(10) Patent No.: US 7,889,839 B2
(45) Date of Patent: Feb. 15, 2011

(54) BETATRON WITH A YOKE MADE OF COMPOSITE POWDER

(75) Inventors: Joerg Bermuth, Mainz (DE); Georg Geus, Wiesbaden (DE); Gregor Hess, Wiesbaden (DE); Urs Viehboeck, Darmstadt (DE)

(73) Assignee: Smiths Heimann GmbH, Wiesbaden (DE)

( * ) Notice: Subject to any disclaimer, the term of this patent is extended or adjusted under 35 U.S.C. 154(b) by 16 days.

(21) Appl. No.: 12/431,626

(22) Filed: Apr. 28, 2009

(65) Prior Publication Data

US 2009/0262899 A1 Oct. 22, 2009

Related U.S. Application Data

(63) Continuation of application No. PCT/EP2007/007766, filed on Sep. 6, 2007.

(30) Foreign Application Priority Data

Oct. 28, 2006 (DE) ..... 10 2006 050 949

(51) Int. Cl.
*H05H 11/00* (2006.01)

(52) U.S. Cl. ..... 378/57; 315/504

(58) Field of Classification Search ..... 378/57, 378/119, 203, 137, 141; 315/504, 501, 500
See application file for complete search history.

(56) References Cited

U.S. PATENT DOCUMENTS

| | | | | |
|---|---|---|---|---|
| 2,297,305 | A | 9/1942 | Kerst | |
| 3,841,870 | A * | 10/1974 | Hamjian | 419/49 |
| 3,975,689 | A * | 8/1976 | Geizer et al. | 315/504 |
| 5,065,418 | A | 11/1991 | Bermbach et al. | |
| 5,115,459 | A * | 5/1992 | Bertozzi | 378/88 |
| 5,122,662 | A | 6/1992 | Chen et al. | |

FOREIGN PATENT DOCUMENTS

| | | |
|---|---|---|
| DE | 23 57 126 | 5/1975 |
| EP | 0 412 190 A1 | 2/1991 |

* cited by examiner

*Primary Examiner*—Hoon Song
(74) *Attorney, Agent, or Firm*—Muncy, Geissler, Olds & Lowe, PLLC

(57) ABSTRACT

A betatron is provided, particularly for an x-ray inspection station, and includes a rotationally symmetrical inner yoke that is composed of two spaced-apart pieces, an outer yoke which connects the two pieces of the inner yoke, at least one main field coil, and at least one toroidal betatron tube located between the pieces of the inner yoke. At least part of the inner yoke and/or the outer yoke can be made of a composite powder.

8 Claims, 2 Drawing Sheets

BETATRON WITH A YOKE MADE OF COMPOSITE POWDER

This nonprovisional application is a continuation of International Application No. PCT/EP2007/007766, which was filed on Sep. 6, 2007, and which claims priority to German Patent Application No. 10 2006 050 949.8, which was filed in Germany on Oct. 28, 2006, and which are both herein incorporated by reference.

BACKGROUND OF THE INVENTION

1. Field of the Invention

The present invention relates to a betatron, particularly to the production of x-radiation in an x-ray inspection system, with a yoke which guides the magnetic flux and includes at least partially of a composite powder.

2. Description of the Background Art

X-ray inspection systems such as the one illustrated in FIG. 2 are used, as is well-known, in the inspection of large-volume articles such as containers and motor vehicles for illegal contents such as weapons, explosives, or contraband goods. In so doing, x-radiation is produced and directed at the article (e.g., target 50). The x-radiation attenuated by the object is measured by means of a detector (e.g., x-ray detector 52) and analyzed by an evaluation unit (e.g., evaluation unit 54). Therefore, a conclusion can be reached on the nature of the object. This type of x-ray inspection system is known, for example, from European Pat. No. EP 0 412 190 B1, which corresponds to U.S. Pat. No. 5,065,418.

Betatrons are used to generate x-radiation with the energy of more than 1 MeV needed for the inspection. These are circular accelerators in which electrons are held in an orbit by a magnetic field. A change in this magnetic field produces an electric field, which accelerates the electrons in their orbit. A stable nominal orbit radius is determined from the so-called Wideroe condition depending on the course of the magnetic field and its change with time. The accelerated electrons are guided onto a target, where upon impacting they produce Bremsstrahlung whose spectrum depends, inter alia, on the energy of the electrons.

A betatron disclosed in Offenlegungsschrift [Unexamined German Pat. Application] No. DE 23 57 126 A1 includes a two-part inner yoke, in which the front sides of both inner yoke parts face each other spaced apart. A magnetic field is produced in the inner yoke by means of two main field coils. An outer yoke connects the two inner yoke part ends distant from one another and closes the magnetic circuit.

An evacuated betatron tube, in which the electrons to be accelerated circulate, is arranged between the front sides of the two inner yoke parts. The front sides of the inner yoke parts are formed in such a way that the magnetic field produced by the main field coil forces the electrons into a circular orbit and moreover focuses them onto the plane in which this orbit lies. To control the magnetic flux, it is prior in the art to arrange a ferromagnetic insert between the front sides of the inner yoke parts within the betatron tube.

In prior-art known betatrons, the yokes include laminated cores, which are formed particularly of transformer sheets. In this respect, the inner yoke in particular must be fabricated very precisely to achieve the greatest possible homogeneity of the magnetic field in the region of the betatron tube. The manufacture of the yokes from laminated cores is therefore complex and expensive, and, moreover, cracks often result during the lamination of the sheets. A mechanical finishing of the laminated cores results in a "smearing" of the surface, which leads to increased eddy current losses during operation. Cleaning of the surface, for example, by an etching process is a conventional procedure to remove this layer, but disadvantageous for reasons of environmental protection and occupational safety.

SUMMARY OF THE INVENTION

It is therefore an object of the present invention to provide a betatron with magnetic yokes that do not have the aforementioned disadvantages.

A betatron according to an embodiment of the present invention has a rotationally symmetric inner yoke of two spaced-apart parts, an outer yoke connecting the two inner yoke parts, at least one main field coil, and a torus-shaped betatron tube arranged between the inner yoke parts. According to the invention, the inner yoke and/or the outer yoke is formed at least partially of a composite powder.

Composite powders are magnetically soft materials. A powder within the scope of this document can be based on an iron or iron powder alloy and can be compressed with use of a binder into molded parts. The molded parts have a high and isotropic specific resistance. In addition, saturation phenomena are avoided at high operating currents as well. Reduced noise development results with the use of magnetostriction-free alloys. The selection of the composition of the composite powder is left to the person skilled in the art practicing the invention, for example, depending on the requirements for the betatron.

The yokes or yoke parts can include a composite powder and can be finished directly mechanically, without additional steps, for example, etching aftertreatment, being necessary. The surfaces of the yokes or yoke parts become considerably smoother and more reproducible than in a manufacture of laminated cores, as a result of which there is a higher homogeneity of the magnetic field formed by the yokes. In addition, the isotropic material properties of the composite powder lead to lower eddy currents and thereby to lower power losses and a higher efficiency during the betatron operation.

In an embodiment of the invention, the inner yoke can be formed completely of a composite powder. This is advantageous, because the manufacture of this rotationally symmetric component from a composite powder is less complex and error-prone in contrast to the manufacture from sheets. Preferably, the outer yoke can include laminated cores, particularly of transformer sheets. Because the outer yoke need not be designed rotationally symmetric and the requirements for the homogeneity of the magnetic field are low in comparison with the inner yoke, a manufacture of the outer yoke from one or several laminated cores is possible. Alternatively, the outer yoke also can be formed totally or partially of a composite powder.

Optionally, the betatron can have at least one round plate between the inner yoke parts, whereby the round plate is arranged so that its longitudinal axis coincides with the rotational symmetry axis of the inner yoke. Because of the permeability of the round plate material, the magnetic field in the region of the round plates is stronger than in the air gap, without round plates, between the front sides of the inner yoke parts. This makes it possible to influence the Wideroe condition by means of the design of the round plate(s) and thereby the orbit radius of the accelerated electrons within the betatron tube. In this case, the round plates preferably are formed of a composite powder.

In an embodiment of the invention, the inner yoke parts can be designed and arranged in such a way that their opposing front sides are mirror-symmetric to one another. The symmetry plane in this regard is advantageously oriented so that the rotational symmetry axis of the inner yoke is perpendicular to it. This results in an advantageous field distribution in the air gap between the front sides by which the electrons in the betatron tube are kept in an orbit.

The betatron of the invention is advantageously used in an x-ray inspection system for security inspection of objects. Electrons are injected into the betatron and accelerated, before they are guided to a target having, for example, tantalum. There, the electrons produce x-radiation with a known spectrum. The x-radiation is directed onto the object, preferably a container and/or a motor vehicle, and there modified, for example, by scattering or transmission attenuation. The modified x-radiation is measured by an x-ray detector and analyzed by means of an evaluation unit. A conclusion on the nature or the content of the object can be reached from the result.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
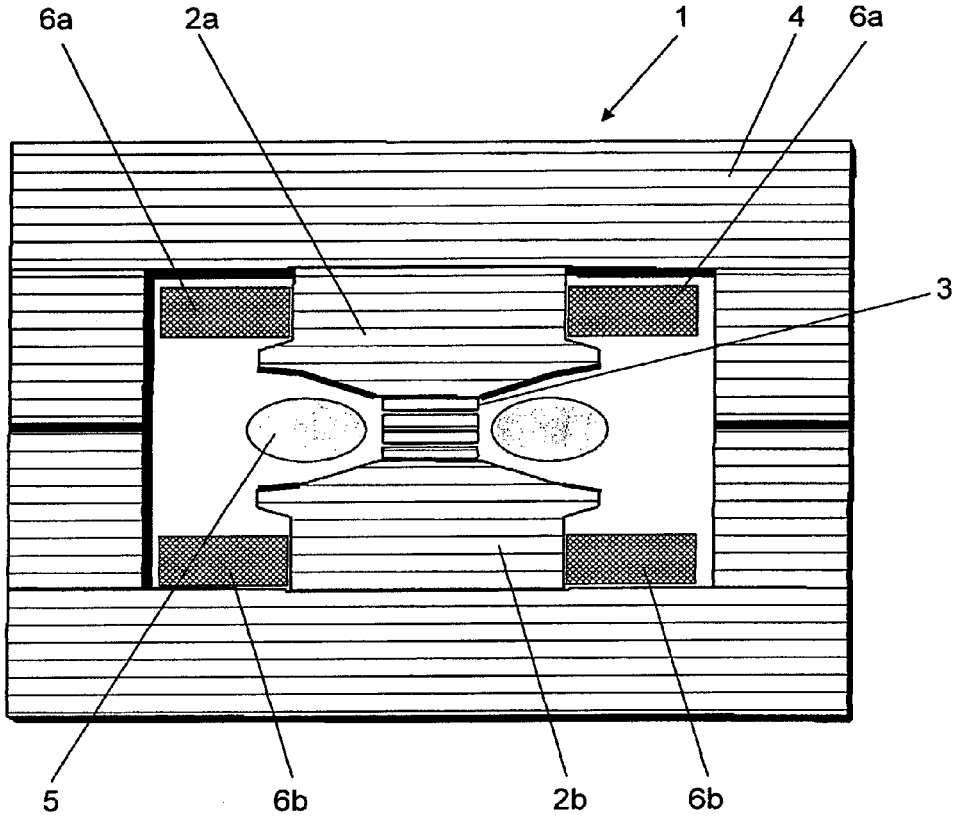
FIG. 1 shows a schematic sectional view of a betatron of the invention.
Figure 2:
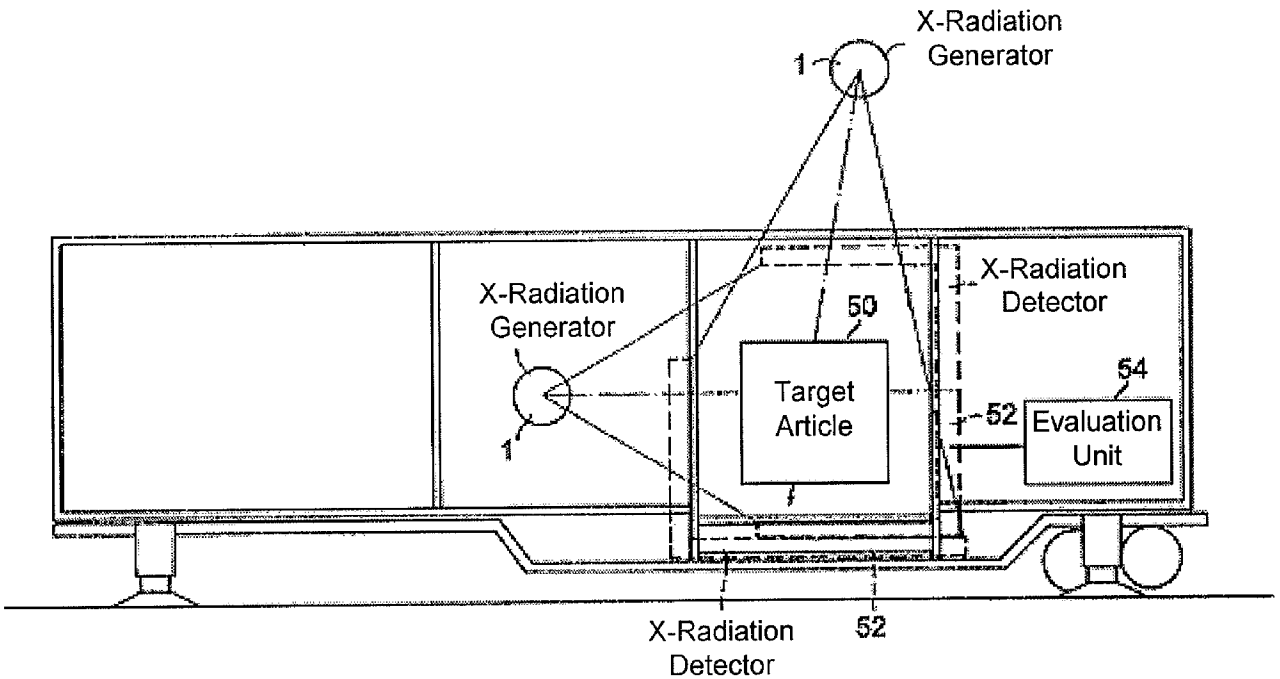
Fig. 2 (Conventional Art)
FIG. 2 shows a conventional x-ray inspection system for security inspection of objects.

FIG. 1 shows the schematic structure of a preferred betatron 1 in cross section. It includes, inter alia, a rotationally symmetric inner yoke of two spaced-apart parts 2*a*, 2*b*, an outer yoke 4 connecting the two inner yoke parts 2*a*, 2*b*, a torus-shaped betatron tube 5 arranged between inner yoke parts 2*a*, 2*b*, and two main field coils 6*a* and 6*b*. Inner yoke parts 2*a*, 2*b* are formed totally of a composite powder, whereas the outer yoke is made as a stack of transformer sheets. Alternatively, outer yoke 4 also is formed of a composite powder.

Owing to the manufacture from a composite powder, complex geometries of the yokes or yoke parts can also be precisely fabricated. In addition, the isotropic material properties reduce the eddy current losses in the yoke.

Main field coils 6*a* and 6*b* are arranged on shoulders of inner yoke parts 2*a* or 2*b*. The magnetic field produced by them penetrates inner yoke parts 2*a* and 2*b*, whereby the magnetic circuit is closed by outer yoke 4. The shape of the inner and/or outer yoke can be selected by the person skilled in the art depending on the application and can deviate from the shape shown in FIG. 1. Only one or more than two main field coils may also be present.

Betatron 1 furthermore has optional round plates 3 between inner yoke parts 2*a*, 2*b*, whereby the longitudinal axis of round plates 3 corresponds to the rotational symmetry axis of the inner yoke. The magnetic field between the front sides of the inner yoke parts and thereby the Wideroe condition can be influenced by the design of round plates 3. The number and/or shape of the round plates are left to the implementing person skilled in the art.

Between the front sides of inner yoke parts 2*a* and 2*b*, the magnetic field runs partially through round plates 3 and otherwise through an air gap. Betatron tube 5 is arranged in said air gap. This is an evacuated tube in which the electrons are accelerated. The front sides of inner yoke parts 2*a* and 2*b* have a shape that is selected so that the magnetic field between them focuses the electrons in an orbit. The design of the front sides is known to the person skilled in the art and is therefore not explained in greater detail. At the end of the acceleration process, the electrons hit a target and thereby produce x-radiation whose spectrum depends, inter alia, on the final energy of the electrons and the material of the target.

For acceleration, the electrons are injected with an initial energy into betatron tube 5. During the acceleration phase, the magnetic field in betatron 1 is continuously increased by main field coils 6*a* and 6*b*. As a result, an electric field is produced that exerts an accelerating force on the electrons. At the same time, due to the Lorentz force, the electrons are forced into a nominal orbit within betatron tube 5.

The acceleration of the electrons is repeated periodically, which results in a pulsed x-radiation. In each period, in a first step the electrons are injected into betatron tube 5. In a second step, the electrons are accelerated by an increasing current in main field coils 6*a* and 6*b* and thereby an increasing magnetic field in the air gap between inner yoke parts 2*a* and 2*b* in the circumferential direction of its orbit. In a third step, the accelerated electrons are deflected onto the target to produce x-radiation. Then an optional pause follows before electrons are again injected into betatron tube 5.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A betatron for an x-ray inspection system, the betatron comprising:

a rotationally symmetric inner yoke having two spaced-apart parts;

an outer yoke connecting the two inner yoke parts;

at least one round plate arranged between the inner yoke parts, wherein the round plate is arranged so that its longitudinal axis coincides with a rotational symmetry axis of the inner yoke;

at least one main field coil; and a torus-shaped betatron tube arranged between the inner yoke parts, wherein the inner yoke and/or the outer yoke are at least partially formed of a composite powder.

2. The betatron according to claim 1, wherein the inner yoke is formed completely of a composite powder.

3. The betatron according to claim 1, wherein the outer yoke includes stacks of metal sheets.

4. The betatron according to claim 1, wherein the outer yoke is formed of a composite powder.

5. The betatron according to claim 1, wherein at least one of the round plates is formed of a composite powder.

6. The betatron according to claim 1, wherein the inner yoke parts are configured and arranged in such a way that their opposing front sides are mirror-symmetric to one another.

7. An x-ray inspection system for security inspection of objects, comprising:

a target to produce x-radiation;

an x-ray detector;

an evaluation unit; and a betatron comprising:

a rotationally symmetric inner yoke having two spaced-apart parts;

an outer yoke connecting the two inner yoke parts;

at least one round plate arranged between the inner yoke parts, wherein the round plate is arranged so that its longitudinal axis coincides with a rotational symmetry axis of the inner yoke;

at least one main field coil; and a torus-shaped betatron tube arranged between the inner yoke parts, wherein the inner yoke and/or the outer yoke are at least partially formed of a composite powder.

8. The betatron according to claim 4, wherein the outer yoke is formed completely of a composite powder.

* * * * *